US008327827B2

(12) United States Patent
Hunt et al.

(10) Patent No.: US 8,327,827 B2
(45) Date of Patent: Dec. 11, 2012

(54) FUEL-INJECTED ENGINE AND METHOD OF ASSEMBLY THEREOF

(75) Inventors: Devlin Hunt, Winthrop Harbor, IL (US); John Feuerstein, Racine, WI (US)

(73) Assignee: BRP US Inc., Sturtevant, WI (US)

( * ) Notice: Subject to any disclaimer, the term of this patent is extended or adjusted under 35 U.S.C. 154(b) by 1360 days.

(21) Appl. No.: 11/932,164

(22) Filed: Oct. 31, 2007

(65) Prior Publication Data

US 2009/0107460 A1 Apr. 30, 2009

(51) Int. Cl.
*F02M 61/04* (2006.01)

(52) U.S. Cl. ..... 123/445; 123/456; 123/514

(58) Field of Classification Search ..... 123/445, 123/456, 468, 469, 470, 509, 73 AD, 196 R, 123/294–296; 29/888.01; 701/103, 104
See application file for complete search history.

(56) References Cited

U.S. PATENT DOCUMENTS

| | | | | |
|---|---|---|---|---|
| 4,543,938 | A * | 10/1985 | Szlaga | 123/514 |
| 5,881,699 | A * | 3/1999 | Brown et al. | 123/514 |
| 5,887,572 | A * | 3/1999 | Channing | 123/514 |
| 5,960,809 | A * | 10/1999 | Keller | 137/12 |
| 6,009,855 | A * | 1/2000 | Espey | 123/456 |
| 6,012,434 | A | 1/2000 | Hartke et al. | |
| 6,213,096 | B1 * | 4/2001 | Kato et al. | 123/456 |
| 6,289,879 | B1 * | 9/2001 | Clausen et al. | 123/516 |
| 6,405,711 | B1 * | 6/2002 | Smith et al. | 123/456 |
| 6,453,877 | B1 | 9/2002 | Lucier et al. | |
| 6,527,947 | B1 * | 3/2003 | Channing et al. | 210/136 |
| 6,848,431 | B2 * | 2/2005 | Kim | 123/514 |
| 7,093,778 | B1 | 8/2006 | Hellmich et al. | |
| 7,267,533 | B1 | 9/2007 | Tocci et al. | |
| 7,353,798 | B2 * | 4/2008 | Tokuda et al. | 123/295 |
| 2002/0152998 | A1 * | 10/2002 | Katayama et al. | 123/541 |

* cited by examiner

*Primary Examiner* — John Kwon
*Assistant Examiner* — Johnny Hoang
(74) *Attorney, Agent, or Firm* — BCF LLP

(57) ABSTRACT

An internal combustion engine is disclosed, having at least one combustion chamber disposed in an engine casing. At least one fuel injector is mounted to the engine casing for supplying fuel to the at least one combustion chamber. The at least one fuel injector has at least one fuel supply inlet. A fuel supply assembly is mounted to the at least one fuel injector. The assembly is mounted adjacent to the at least one fuel injector for supplying the fuel to the fuel injector. The assembly has at least one fuel supply outlet. The assembly is mounted to the at least one fuel injector by a cooperative fit, such that the at least one fuel supply inlet and the at least one fuel supply outlet align in a sealed relationship to allow fluid communication therebetween. A method of assembling an engine is also disclosed.

16 Claims, 8 Drawing Sheets

Section 5-5

FUEL-INJECTED ENGINE AND METHOD OF ASSEMBLY THEREOF

FIELD OF THE INVENTION

The present invention relates to an arrangement of the fuel pump, vapor separator and fuel injectors of an internal combustion engine, and a method for assembling an engine.

BACKGROUND OF THE INVENTION

Internal combustion engines operate by the combustion of fuel in one or more combustion chambers. In fuel-injected engines, one or more fuel injectors are mounted to the engine to supply the fuel to each combustion chamber. The fuel is stored in a fuel tank, and is typically supplied to the fuel injectors from the fuel tank via a vapor separator, a fuel pump and a fuel rail. A pump draws fuel from the fuel tank and supplies it to the vapor separator. The vapor separator removes vapor from the fuel. The fuel pump draws liquid fuel from the vapor separator and pumps the liquid fuel through a high-pressure fuel line to a fuel rail. The injectors draw fuel from the fuel rail and deliver the fuel to the combustion chambers. The quantity of fuel supplied to the combustion chambers is regulated by the injectors. The fuel pump generally supplies more fuel than is needed by the injectors, to ensure an uninterrupted fuel supply. A fuel return path is provided from the fuel rail to either the fuel pump, the vapor separator or the fuel tank, for returning excess fuel that is supplied to the fuel rail and not used by the injectors.

While this system is adequate for supplying fuel to an engine, it has a number of drawbacks. Assembly of the fuel supply system described above requires many components to be interconnected. Some of the components can be difficult to align during assembly, and many individual connections must be made between components, resulting in increased manufacturing cost. In particular, the high-pressure fuel line is relatively expensive as it must be manufactured to withstand the high pressure of the fuel exiting the fuel pump. In addition, the multiplicity of components increases the chance of failure of any one component, such as a leak in the high-pressure fuel line, which may interrupt the adequate supply of fuel to the engine. In addition, the multiplicity of components makes it more difficult to obtain a compact arrangement, which is desired in some applications such as in marine outboard engines.

Therefore, there is a need for a fuel injection system of an engine having a reduced number of parts.

There is also a need for a fuel injection system having a compact arrangement.

There is also a need for a fuel injection system having increased ease of assembly.

SUMMARY OF THE INVENTION

It is an object of the present invention to ameliorate at least some of the inconveniences present in the prior art.

It is a further object of the present invention to provide a fuel injection system with a reduced number of parts.

It is a further object of the present invention to provide a fuel injection system having a compact arrangement.

It is a further object of the present invention to provide a fuel injection system having increased ease of assembly.

It is a further object of the present invention to provide a fuel supply assembly, including a fuel pump and vapor separator, that is capable of being mounted directly to the fuel injectors of an internal combustion engine. The fuel supply assembly is mounted to the fuel injectors by male and female connectors to form a cooperative fit. A fuel supply path is provided from the fuel supply assembly to the fuel injectors, and a fuel return path is provided from the fuel injectors to the fuel pump and vapor separator assembly.

Because the fuel injectors are mounted to the engine casing and the fuel supply assembly is then mounted to the fuel injectors, tolerance stacking occurs in the alignment of the various connectors, fuel inlets and outlets of the fuel injectors with the corresponding features of the fuel supply assembly. Therefore, an appropriate degree of manufacturing precision is required to ensure that the housing and the fuel injectors fit well together, and to ensure alignment of the corresponding features of both components.

In one aspect, the invention provides an internal combustion engine, comprising an engine casing. At least one combustion chamber is disposed in the engine casing. At least one fuel injector assembly is mounted to the engine casing and fluidly communicates with the at least one combustion chamber for supplying fuel thereto. The at least one fuel injector has at least one fuel supply inlet. A fuel supply assembly is mounted to the at least one fuel injector assembly. The fuel supply assembly is mounted adjacent to the at least one fuel injector assembly for supplying the fuel to the fuel injector assembly. The fuel supply assembly comprises a fuel pump. The fuel supply assembly has at least one fuel supply outlet. The fuel supply assembly is mounted to the at least one fuel injector assembly by a cooperative fit, such that the at least one fuel supply inlet and the at least one fuel supply outlet align in a sealed relationship to allow fluid communication therebetween.

In a further aspect, one of the fuel supply assembly and the fuel injector assembly has at least one male connector. The other of the fuel supply assembly and the fuel injector assembly has at least one female connector. The at least one male connector matingly engages the at least one female connector to form the cooperative fit.

In a further aspect, the at least one male connector includes a corresponding one of the fuel supply inlet and the fuel supply outlet. The at least one female connector includes the other of the fuel supply inlet and the fuel supply outlet. The at least one male connector and the at least one female connector mate to provide the fluid communication between the at least one fuel supply inlet and the at least one fuel supply outlet.

In a further aspect, the fuel supply assembly further comprises a vapor separator for supplying the fuel to the fuel pump.

In a further aspect, the vapor separator and the fuel pump are disposed in a common housing.

In a further aspect, the fuel pump assembly further comprises at least one fuel return inlet. The at least one fuel injector further comprises at least one fuel return outlet in fluid communication with the at least one fuel return inlet for returning unused fuel from the at least one fuel injector to the fuel pump assembly.

In a further aspect, the at least one fuel return inlet and the at least one fuel return outlet align in a sealed relationship to allow the fluid communication between the at least one fuel return outlet and the at least one fuel return inlet.

In a further aspect, one of the fuel supply assembly and the fuel injector assembly has at least one male connector. The other of the fuel supply assembly and the fuel injector assembly has at least one female connector. The at least one male connector matingly engages the at least one female connector to form a cooperative fit between the at least one fuel return inlet and the at least one fuel return outlet.

In a further aspect, the at least one male connector includes a corresponding one of the fuel return inlet and the fuel return outlet. The at least one female connector includes the other of the fuel return inlet and the fuel return outlet. The at least one male connector and the at least one female connector mate to provide the fluid communication between the at least one fuel return inlet and the at least one fuel return outlet.

In a further aspect, the at least one male connector and the at least one female connector matingly engaged therewith comprise a sealing member disposed therebetween, forming a sealed relationship therebetween.

In a further aspect, the fuel pump assembly and the at least one fuel injector are fastened together by at least one fastener.

In a further aspect, the fuel pump assembly is mounted to the engine casing and fastened thereto by at least one fastener.

In an additional aspect, the invention provides a method of assembling an internal combustion engine. The internal combustion engine comprises an engine casing. At least one combustion chamber is formed in the engine casing. The method comprises: mounting at least one fuel injector assembly to the engine casing; and mounting a fuel supply assembly to the at least one fuel injector by a cooperative fit, such that the fuel supply assembly is mounted adjacent to the at least one fuel injector assembly, such that a fuel supply outlet of the fuel supply assembly aligns with a fuel supply inlet of the fuel injector assembly in a sealed relationship to allow fluid communication therebetween.

In a further aspect, the method further comprises fastening the fuel supply assembly to the at least one fuel injector assembly via at least one fastener.

In a further aspect, the method further comprises fastening the fuel supply assembly to the engine casing via at least one fastener.

In an additional aspect, the invention provides an internal combustion engine, comprising an engine casing. At least one combustion chamber is disposed in the engine casing. At least one fuel injector is mounted to the engine casing and fluidly communicates with the at least one combustion chamber for supplying fuel thereto. The at least one fuel injector has at least one fuel supply inlet. A vapor separator assembly is mounted to the at least one fuel injector. The vapor separator assembly is mounted adjacent to the at least one fuel injector for supplying the fuel to the fuel injector. The vapor separator assembly comprises a vapor separator. The vapor separator assembly has at least one fuel supply outlet. The vapor separator assembly is mounted to the at least one fuel injector by a cooperative fit, such that the at least one fuel supply inlet and the at least one fuel supply outlet align in a sealed relationship to allow fluid communication therebetween.

In a further aspect, the vapor separator assembly comprises a vapor separator casing. The vapor separator is formed within the casing.

In a further aspect, one of the vapor separator assembly and the fuel injector has at least one male connector. The other of the vapor separator assembly and the fuel injector has at least one female connector. The at least one male connector matingly engages the at least one female connector to form the cooperative fit.

In a further aspect, the vapor separator assembly further comprises at least one fuel return inlet. The at least one fuel injector further comprises at least one fuel return outlet in fluid communication with the at least one fuel return inlet for returning unused fuel from the at least one fuel injector to the vapor separator assembly.

In the present application the terms "cooperative fit" are used to mean a fit between two components that have complementary or reciprocal features such that the contour of one component at least partially follows the contour of the other component.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
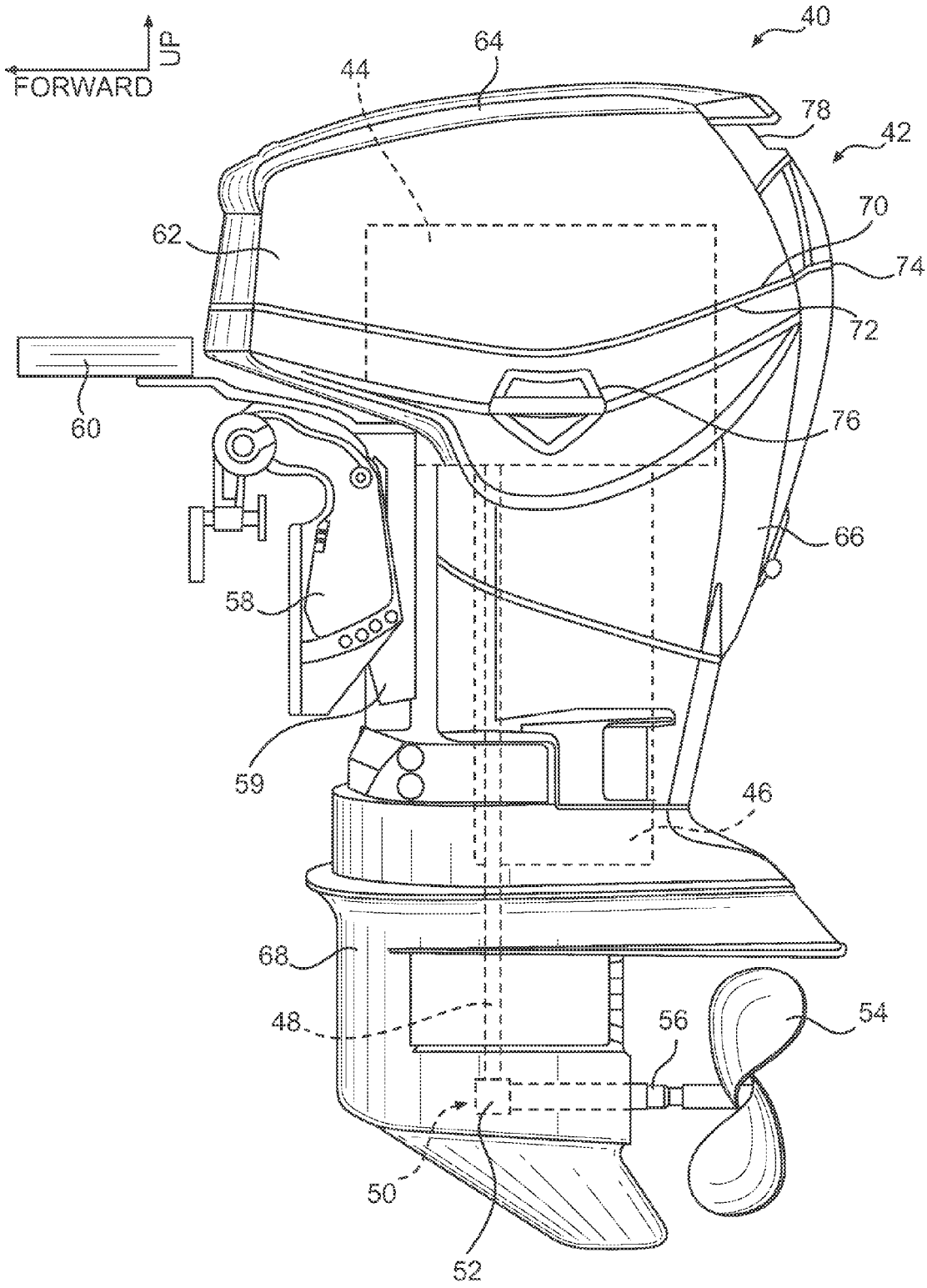
FIG. 1 is a side elevation view of a marine outboard motor incorporating an engine according to the present invention.

Referring to the figures, FIG. 1 is a side view of a marine outboard engine 40 having a cowling 42. The cowling 42 surrounds and protects an engine 44, shown schematically. The engine 44 will be described below in further detail. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor, such as a propeller 54 mounted on a propeller shaft 56. The propeller shaft 56 is generally perpendicular to the driveshaft 48. The drive mechanism 50 could also include a jet propulsion device, turbine or other known propelling device. The bladed rotor could also be an impeller. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via the swivel bracket 59 for mounting the outboard engine 40 to a watercraft. The stern bracket 58 can take various forms, the details of which are conventionally known.

A tiller 60 is operatively connected to the cowling 42, to allow manual steering of the outboard engine 40. It is contemplated that other steering mechanisms could be provided to allow steering, such as the steering wheel of a boat.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, in a known manner. The propeller shaft 56 extends from the gear case 68 and supports the propeller 54.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 10.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 2:
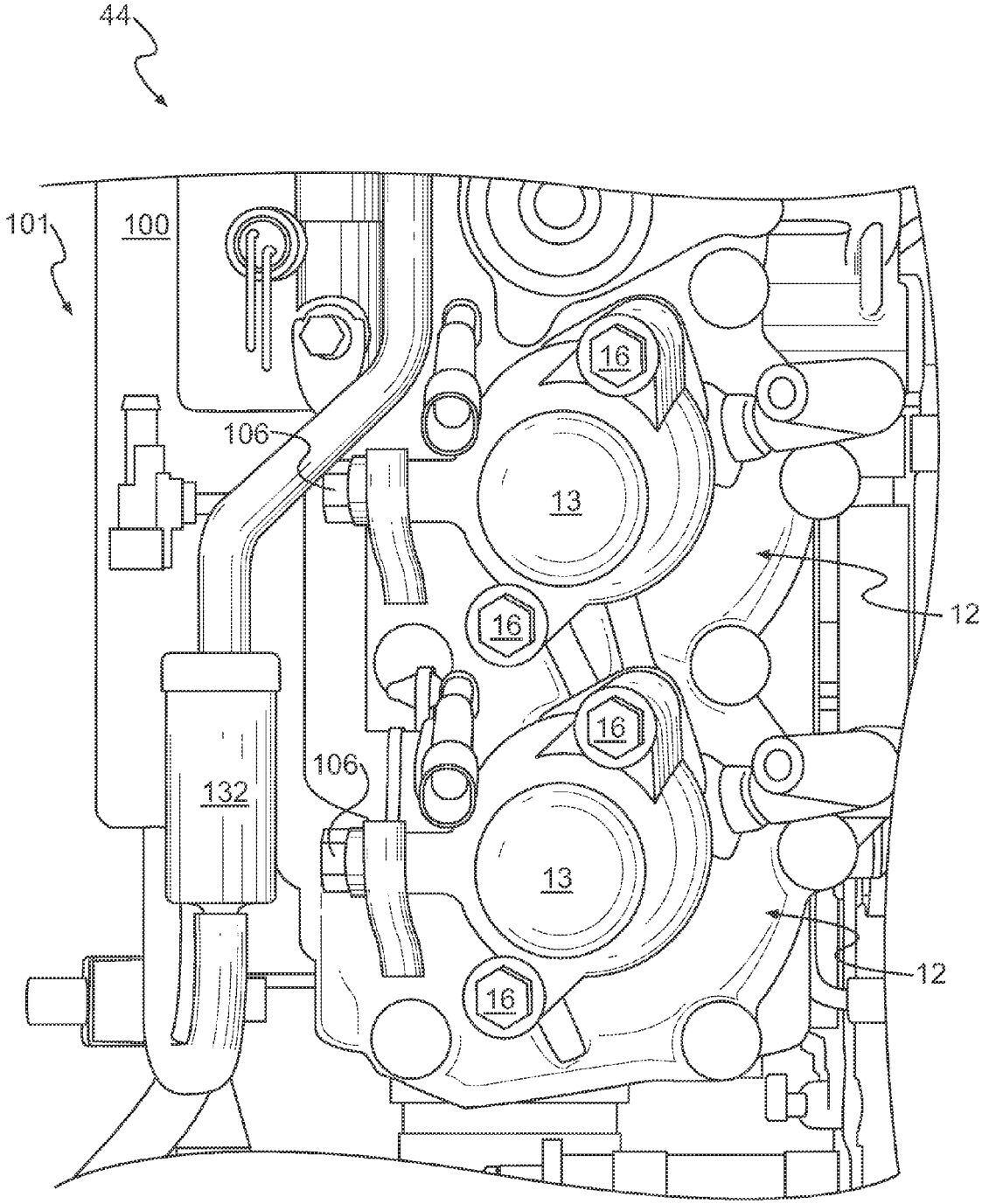
FIG. 2 is a perspective view of an internal combustion engine according to the present invention.

Referring to FIG. 2, the engine 44 will be described in accordance with an embodiment of the present invention.

The engine 44 is an in-line, two-cylinder, two-cycle, direct-injected engine. The present invention is not restricted to any particular type of engine, and can also be practiced with four-cycle engines, as well as with engines having more or fewer cylinders, and with different cylinder bank configurations, such as V-type engines.

Figure 3A:
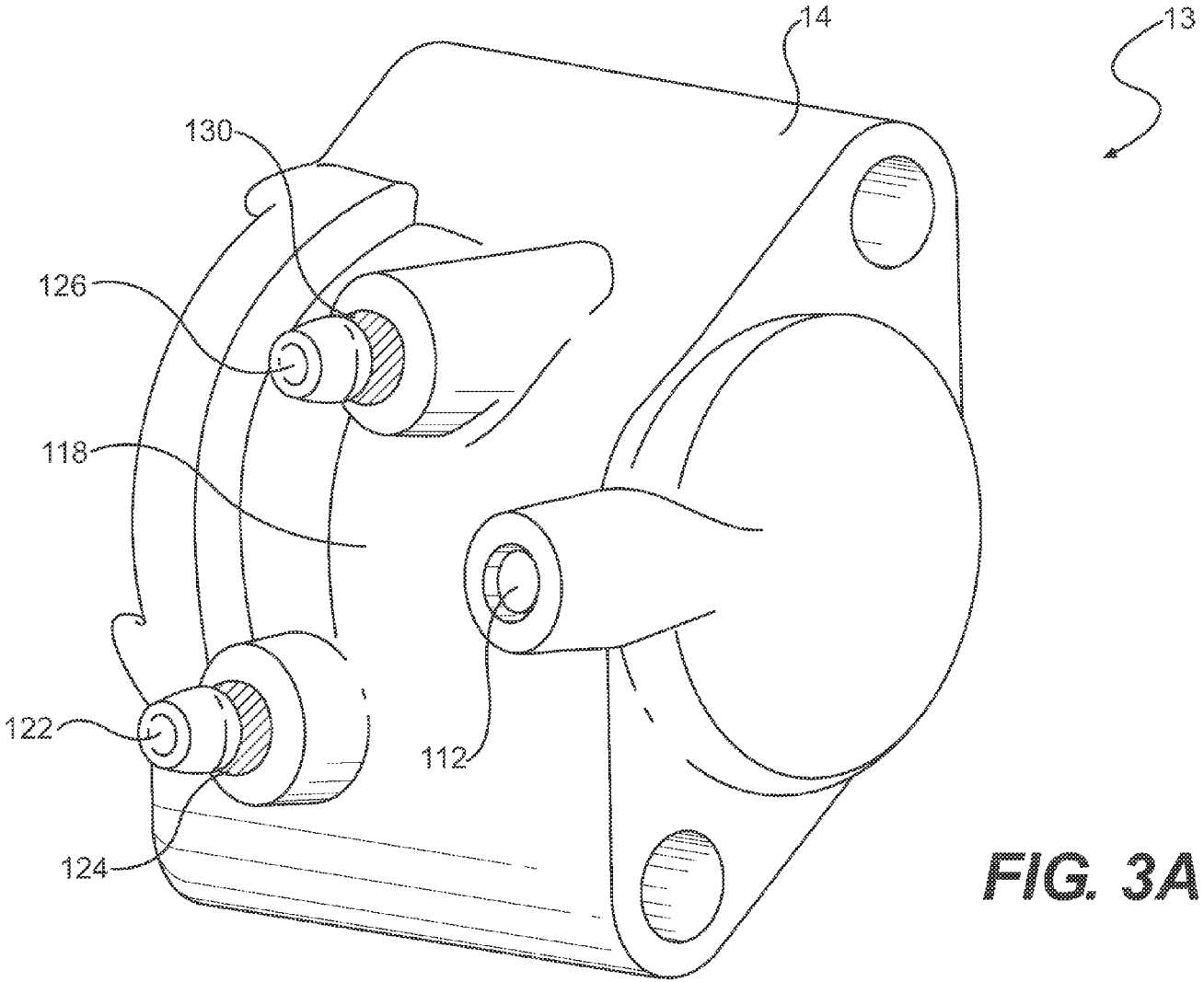
FIG. 3A is a perspective view of a fuel injector housing according to the present invention.
Figure 3B:
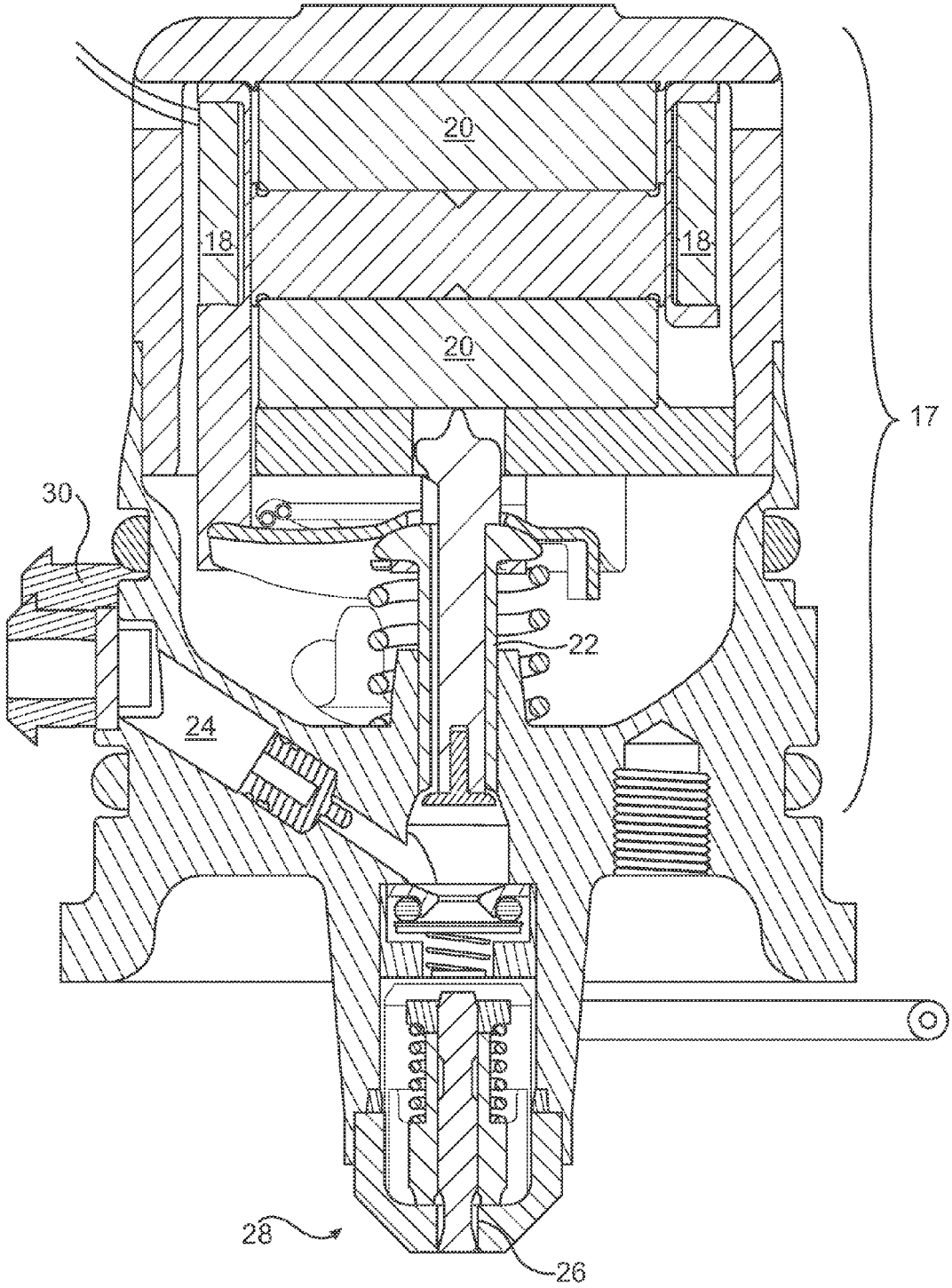
FIG. 3B is a cross-sectional view of an embodiment of a fuel injector to be used in an engine according to the present invention.

The engine 44 has an engine casing 10 with two combustion chambers 12 formed therein. Two fuel injector assemblies 13 are mounted to the engine casing 10 via bolts 16. Each combustion chamber 12 receives fuel from a respective fuel injector assembly 13. The fuel injector assemblies 13 fluidly communicate with the combustion chambers 12. Each fuel injector assembly 13 includes a fuel injector housing 14. Each housing contains therein an electronically-actuated fuel injector 17 of the type shown in FIG. 3B for injecting fuel for combustion in the combustion chambers 12. An electrical current in a wire coil 18 causes the wire coil 18 and one or more magnets 20 to reciprocate with respect to one another. The reciprocating motion of the fuel injector 17 drives a plunger 22 to cause fuel to be drawn in through the fuel supply inlet 122 via the intake passage 24 and expelled via the annular path 26 in the nozzle assembly 28, for combustion in a combustion chamber 12. Excess fuel exits the fuel injector assembly 13 via the return passageway 30 and the fuel return outlet 126. The fuel supply inlet 122 and the fuel return outlet 126 are shaped to act as male connectors. The fuel supply inlet 122 is provided with a sealing ring 124 and the fuel return outlet 126 is provided with a sealing ring 130. The workings and specific internal components of this type of fuel injector are described in detail in U.S. Pat. No. 7,267,533, which is incorporated herein by reference in its entirety. It should be understood that the fuel injector may instead be of any other suitable type, such as a mechanically actuated fuel injector, as long as the fuel injector assembly is provided with suitable connectors.

Figure 4A:
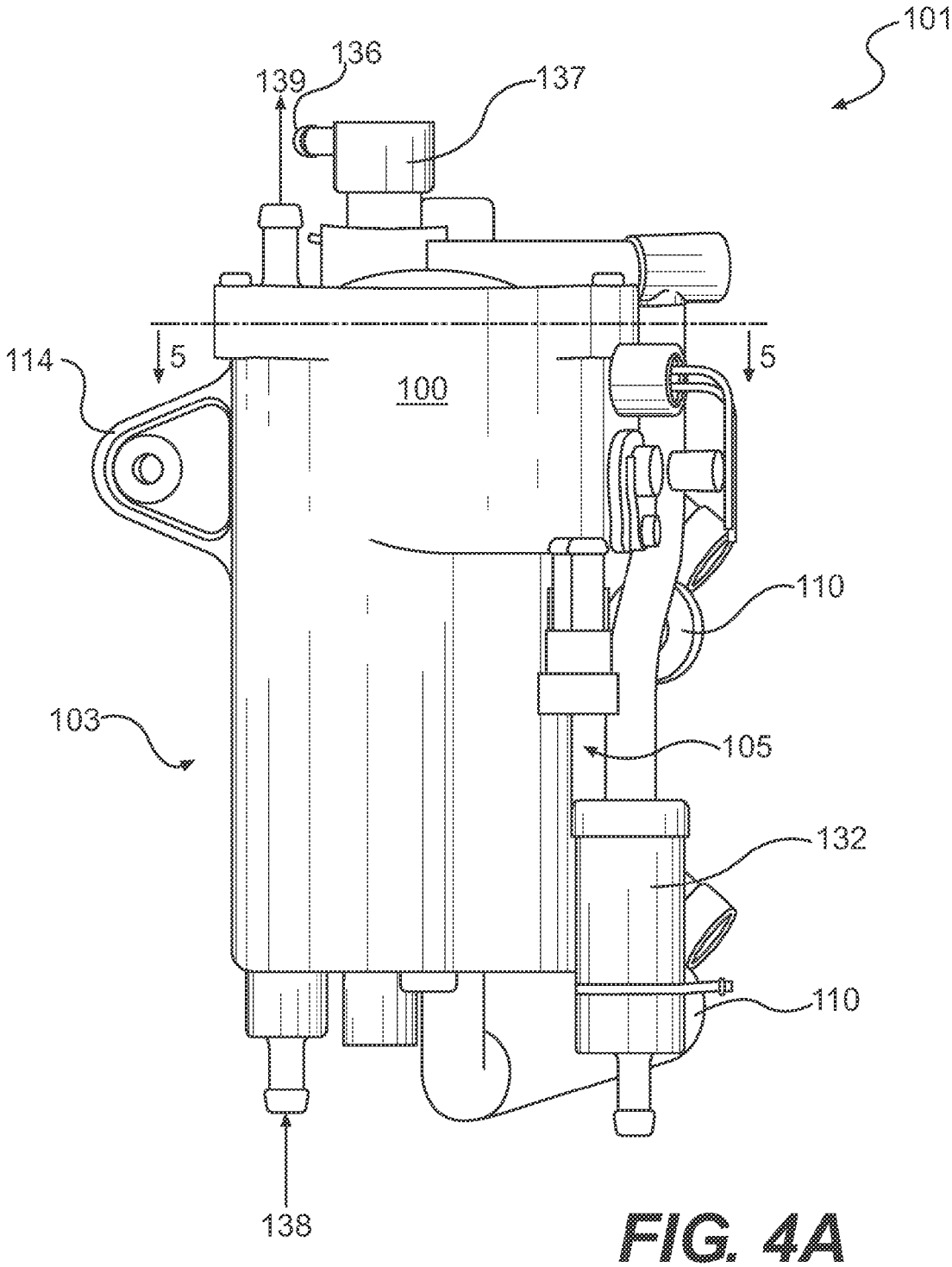
FIGS. 4A and 4B are, respectively, side elevation and perspective views of a fuel supply assembly according to the present invention.
Figure 4B:
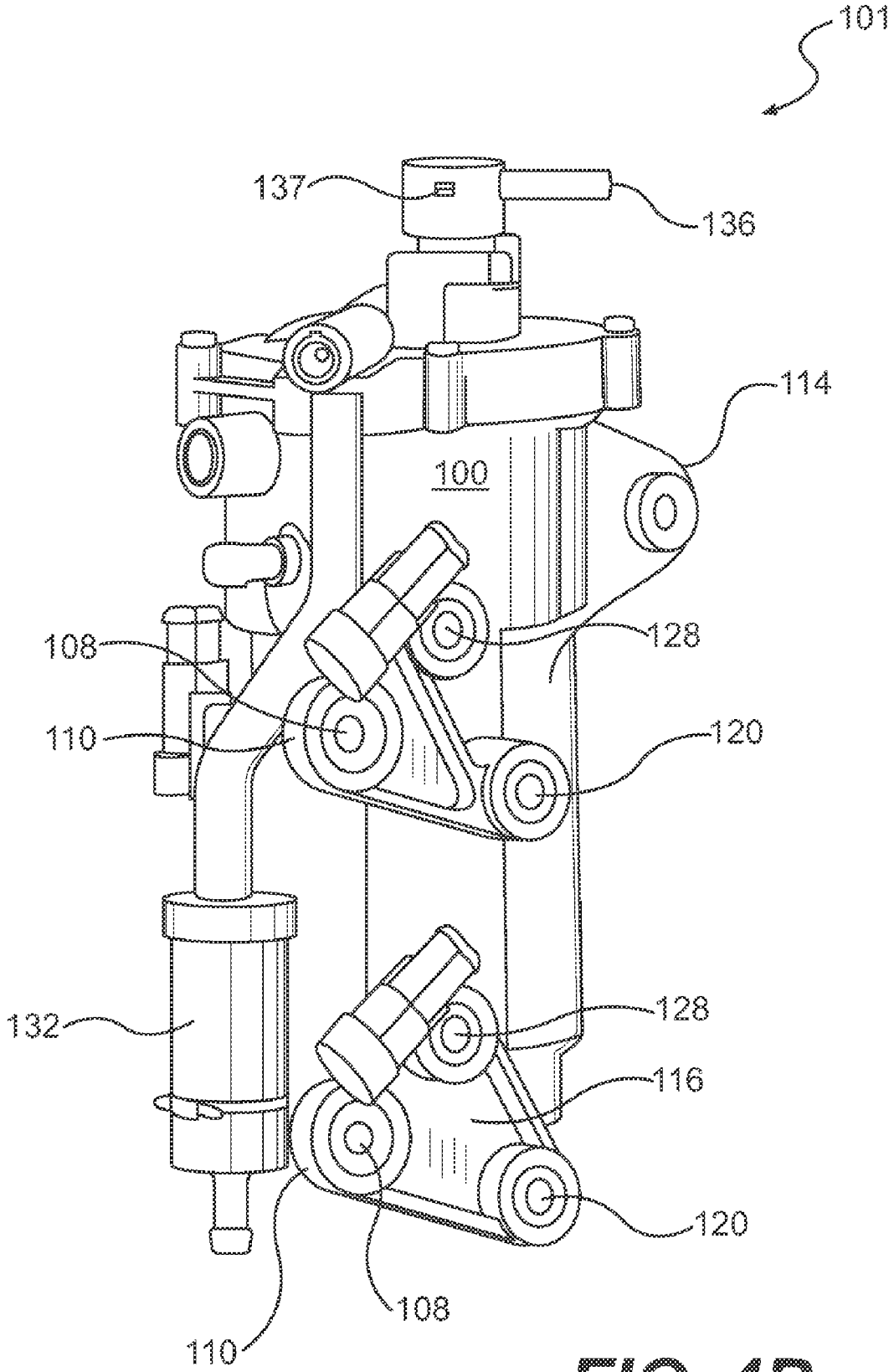

Referring now to FIGS. 4A and 4B, the fuel supply assembly 101 is formed in the housing 100 and supplies fuel to the fuel injectors 17 as will be described in further detail below. The housing 100 encloses a vapor separator assembly 103 comprising a vapor separator 102. The vapor separator assembly is partially formed by the housing 100, as will be described below in further detail. It is contemplated that the vapor separator 102 may alternatively be wholly formed by the housing 100 or formed by a separate chamber located within the housing 100. The housing 100 further encloses a fuel pump assembly 105 comprising a fuel pump 104. The fuel pump assembly 105 is partially formed by the housing 100, as will be described below in further detail. It is contemplated that the fuel pump assembly may alternatively be wholly formed by the housing 100 or contained in separate chamber located within the housing 100. It is further contemplated that the fuel supply assembly 101 may alternatively include only one or the other of the vapor separator assembly 103 and the fuel pump assembly 105.

The fuel supply assembly 101 is mounted to the fuel injector assemblies 13 via bolts 106 (best seen in FIG. 2) inserted through bores 108 in the mounting flanges 110 of the housing 100 and into the mounting bores 112 (seen in FIG. 3A) of the fuel injector housings 14. It is contemplated that the fuel supply assembly 101 could alternatively be mounted to the fuel injector assemblies 13 via any other suitable fastener, such as screws or rivets. A mounting flange 114 allows the fuel supply assembly 101 to additionally be mounted to the engine casing 10 by a fastener (not shown) in a similar manner. It is contemplated that the fuel supply assembly 101 may alternatively be mounted to the engine casing 10 by more than one mounting flange 114 and a corresponding number of fasteners, or that the fuel supply assembly 101 may alternatively be mounted only to the fuel injector assemblies 14 and not to the engine casing 10. The fuel pump 104 expels fuel out of the fuel supply assembly 101 via the fuel supply outlet 120. Excess fuel not used by the fuel injectors 17 is returned to the interior of the housing 100 via the fuel return inlet 128. The fuel supply outlet 120 and the fuel return inlet 128 are shaped to act as female connectors suitable for receiving the male connectors 122 and 126, respectively. The operation of the vapor separator 102 and the fuel pump 104 will be described below in further detail.

Figure 6:
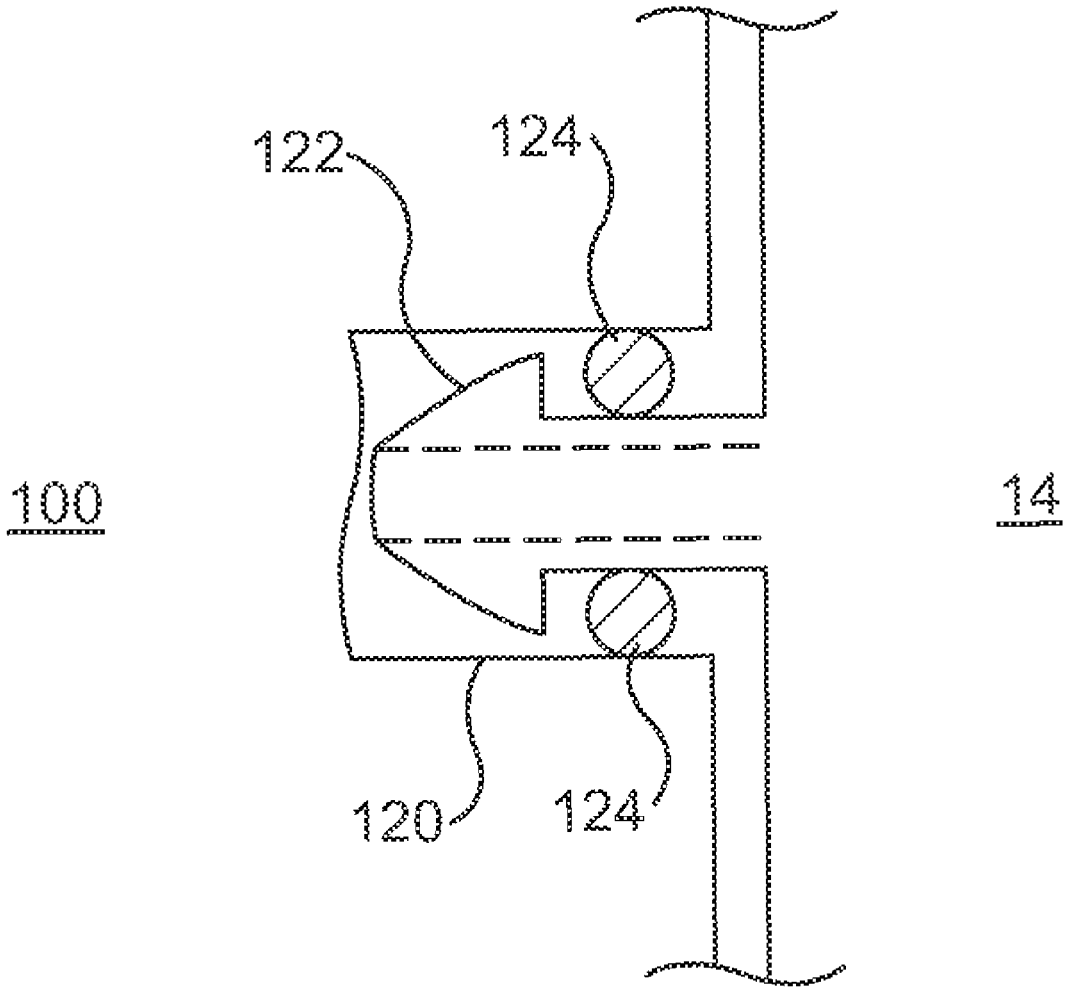
FIG. 6 is a cross-sectional view of the fuel supply inlet and outlet in a cooperative fit according to the present invention.

When the fuel supply assembly 101 is mounted to the fuel injector assemblies 13, portions of the mounting face 116 (seen in FIG. 4B) of the housing 100 mate with corresponding portions of the mounting face 118 (seen in FIG. 3A) of the fuel injector housings 14 to form a cooperative fit therebetween. The fuel supply outlets 120 of the housing 100 receive the fuel supply inlets 122 of the respective fuel injector housings 14 as shown in FIG. 6. The sealing ring 124 is disposed between each fuel supply inlet 122 and the respective fuel supply outlet 120, to form a sealed relationship therebetween. Similarly, each fuel return outlet 126 is received in a corresponding fuel return inlet 128 of the fuel supply assembly 101. The sealing ring 130 is disposed between the fuel return outlet 126 and the fuel return inlet 128 to form a sealed relationship therebetween. It is contemplated that the sealing rings 124, 130 may alternatively be any other suitable sealing members, such as fluorocarbon sleeves. It is further contemplated that some or all of the male connectors may instead be formed on the housing 100 and the corresponding female connectors formed on the fuel injector housing 14.

The operation of the fuel supply and injection system will now be described in detail.

Figure 5:
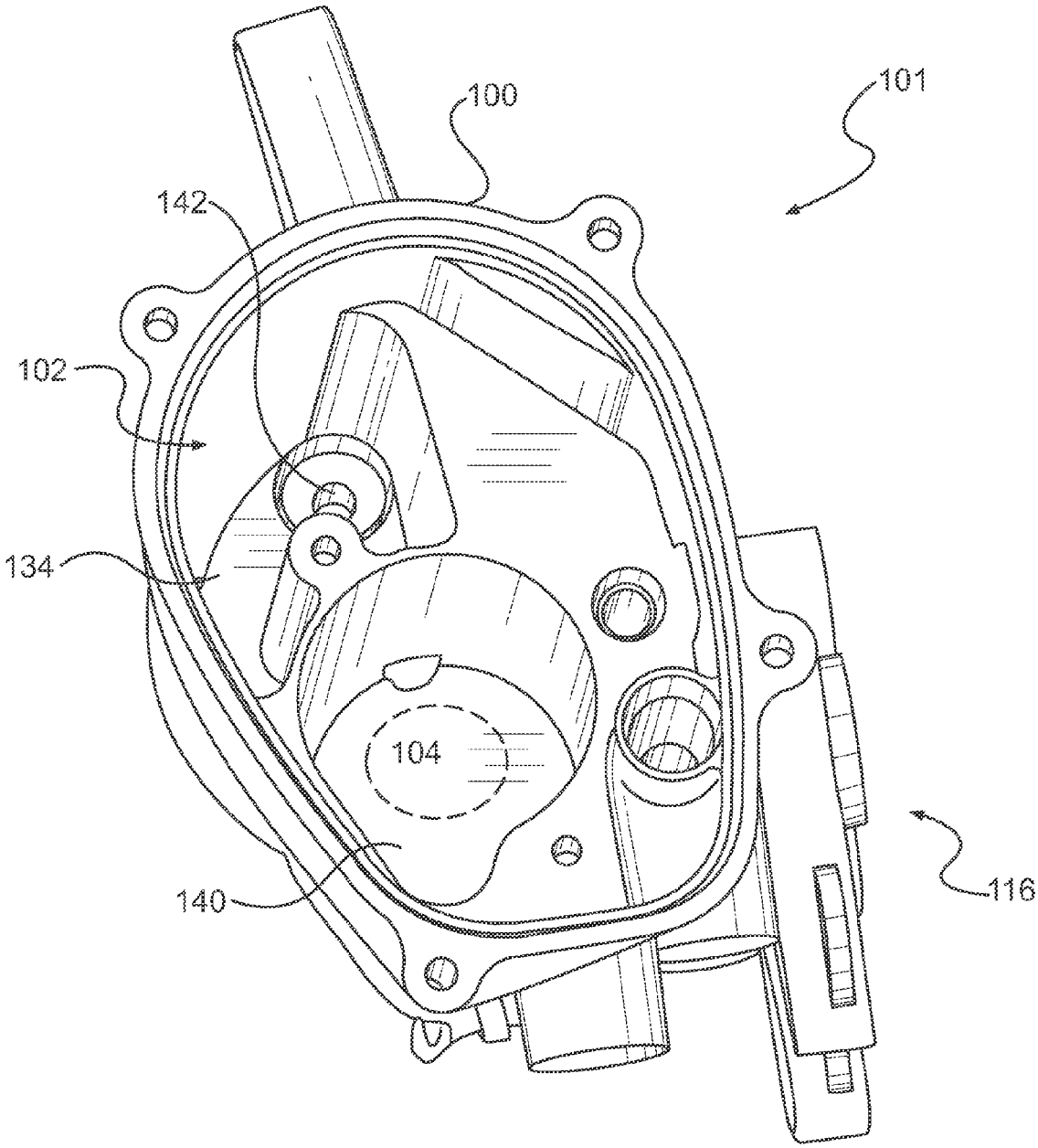
FIG. 5 is a cross-sectional view of the fuel supply assembly of FIG. 4A taken along line 5-5 in FIG. 4A.

Fuel is delivered to the interior of the housing 100 from a fuel tank (not shown) via a lift pump (not shown), after passing through a filter 132 (best seen in FIGS. 4A and 4B) to remove any debris that may be present in the fuel. When the fuel enters the housing 100 it is collected in the reservoir 134 formed in the interior of the housing 100, as seen in FIG. 5. A flow of cooling water is provided through the housing 100 via the water inlet 138 and the water outlet 139, to cool the fuel in the vapor separator 102 and help prevent the formation of fuel vapor. The reservoir 134 acts as the fuel vapor separator 102, allowing fuel vapor to collect above the reservoir 134. The vapor can be released via the vent 136 (best seen in FIGS. 4A and 4B), which is equipped with a roll-over valve 137 to prevent liquid fuel from escaping in the event that the engine is inverted during operation. Liquid fuel remains in the reservoir 134.

A fuel pump 104 (shown schematically) disposed in the reservoir 140 draws liquid fuel from the reservoir 134 via the aperture 142 in the bottom of the reservoir 134. The fuel pump 104 expels fuel out of the fuel supply assembly 101 via the fuel supply outlets 120, and into the fuel injectors 17 via the fuel supply inlets 122 in the fuel supply housings 14. The fuel injectors 17 regulate the quantity of fuel supplied to each combustion chamber 12, and any unused fuel exits the fuel injector assemblies 13 via the fuel return outlets 126 and is returned to the interior of the housing 100 via the fuel return inlets 128.

The assembly of the fuel supply assembly 101 and the fuel injector assemblies 13 to the engine 44 will now be described. The fuel injector assemblies 13 are first attached to the engine casing 10 such that the nozzle assembly 28 of each fuel injector 17 is in fluid communication with a respective combustion chamber 12 of the engine 44. Each fuel injector housing 14 is then fastened to the engine casing 10 via the bolts 16. The housing 100 is then positioned adjacent the fuel injector assemblies 13 such that the male connectors 122 mate with the female connectors 120 to form a cooperative fit, and the male connectors 126 mate with the female connectors 128 to form a cooperative fit. The sealing rings 124 and 130 create a sealing relationship between the respective pairs of connectors. It is contemplated that the sealing rings 124 and 130 may alternatively be any other suitable sealing members, such as fluorocarbon sleeves. It is contemplated that one or more of the male connectors may alternatively be disposed on the housing 100, in which case corresponding female connectors would be disposed on the fuel injector housings 14. When the housing is in this position, the bores 108 in the mounting flanges 110 of the housing 100 are in alignment with the bores 112 in the fuel injector housings 14. Bolts 106 are then inserted through the bores 108 and 112 to fasten the housing 100 to the fuel injector housings 14.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An internal combustion engine, comprising:

an engine casing;

at least one combustion chamber disposed in the engine casing;

at least one fuel injector assembly mounted to the engine casing and fluidly communicating with the at least one combustion chamber for supplying fuel thereto, each of the at least one fuel injector assembly having:

a fuel injector housing;

a fuel injector disposed at least in part in the fuel injector housing;

at least one fuel supply inlet fluidly communicating with the fuel injector for supplying fuel to the fuel injector; and at least one fuel return outlet fluidly communicating with the fuel injector for returning excess fuel from the fuel injector;

a fuel supply assembly housing fastened to the fuel injector housing of the at least one fuel injector;

a fuel supply assembly fluidly communicating with the at least one fuel injector assembly for supplying fuel to the fuel injector assembly, the fuel supply assembly comprising:

a fuel pump assembly disposed at least in part in the fuel supply assembly housing;

a vapor separator assembly disposed at least in part in the fuel supply assembly housing;

at least one fuel supply outlet being fluidly connected to the at least one fuel supply inlet of the at least one fuel injector assembly via at least one first cooperative fit for supplying fuel from the fuel supply assembly to the at least one fuel injector assembly; and at least one fuel return inlet being fluidly connected to the at least one fuel return outlet of the at least one fuel injector assembly via at least one second cooperative fit for returning fuel from the at least one fuel injector assembly to the fuel supply assembly.

2. The internal combustion engine of claim 1, wherein:

one of the fuel supply assembly housing and the at least one fuel injector assembly has at least one first male connector;

an other of the fuel supply assembly housing and the at least one fuel injector assembly has at least one first female connector;

the at least one first male connector matingly engages the at least one first female connector to form the at least one first cooperative fit;

one of the fuel supply assembly housing and the at least one fuel injector assembly has at least one second male connector;

an other of the fuel supply assembly housing and the at least one fuel injector assembly has at least one second female connector; and the at least one second male connector matingly engages the at least one second female connector to form the at least one second cooperative fit.

3. The internal combustion engine of claim 2, wherein;

the at least one first male connector includes a corresponding one of the at least one fuel supply inlet and the at least one fuel supply outlet;

the at least one first female connector includes an other of the at least one fuel supply inlet and the at least one fuel supply outlet;

the at least one first male connector and the at least one first female connector mate to fluidly connect the at least one fuel supply inlet with the at least one fuel supply outlet;

the at least one second male connector includes a corresponding one of the at least one fuel return inlet and the at least one fuel return outlet;

the at least one second female connector includes an other of the at least one fuel return inlet and the at least one fuel return outlet; and the at least one second male connector and the at least one second female connector mate to fluidly connect the at least one fuel return inlet with the at least one fuel return outlet.

4. The internal combustion engine of claim 1, wherein the vapor separator assembly is fluidly connected to the fuel pump assembly for supplying fuel to the fuel pump assembly.

5. The internal combustion engine of claim 2, wherein:

the at least one first male connector and the at least one first female connector matingly engaged therewith comprise a first sealing member disposed therebetween, forming a sealed relationship therebetween; and the at least one second male connector and the at least one second female connector matingly engaged therewith comprise a second sealing member disposed therebetween, forming a sealed relationship therebetween.

6. The internal combustion engine of claim 1, wherein the fuel supply assembly housing and the fuel injector housing of the at least one fuel injector assembly are fastened together by at least one fastener.

7. The internal combustion engine of claim 6, wherein the fuel supply assembly housing is mounted to the engine casing and fastened thereto by at least one fastener.

8. The internal combustion engine of claim 6, wherein:

the fuel supply assembly housing includes at least one bore;

the fuel injector housing of the at least one fuel injector assembly includes a mounting bore; and the at least one fastener is inserted in the at least one bore of the fuel supply assembly and the mounting bore of the fuel injector housing of the at least one fuel injector assembly.

9. The internal combustion engine of claim 8, wherein:

the fuel supply assembly housing includes at least one mounting flange; and the at least one bore of the fuel supply assembly is defined in the at least one mounting flange.

10. The internal combustion engine of claim 9, wherein the at least one fuel supply outlet and the at least one fuel return inlet are defined at least in part by the at least one mounting flange.

11. The internal combustion engine of claim 1, wherein the at least one fuel supply outlet and the at least one fuel return inlet are defined at least in part by the fuel supply assembly housing.

12. The internal combustion engine of claim 1, wherein the at least one fuel supply inlet and the at least one fuel return outlet are defined at least in part by the fuel injector housing of the at least one fuel injector assembly.

13. The internal combustion engine of claim 1, wherein the vapor separator assembly is at least partially formed by the fuel supply assembly housing.

14. The internal combustion engine of claim 1, wherein the fuel pump assembly is at least partially formed by the fuel supply assembly housing.

15. The internal combustion engine of claim 1, wherein:

the at least one fuel injector assembly is two fuel injector assemblies;

for each of the two fuel injector assemblies:

the at least one fuel supply inlet is one fuel supply inlet; and the at least one fuel return outlet is one fuel return outlet;

the at least one fuel supply outlet is two fuel supply outlets;

the at least one fuel return inlet is two fuel return inlets;

the at least one first cooperative fit is two first cooperative fits; and the at least one second cooperative fit is two second cooperative fits.

16. The internal combustion engine of claim 1, wherein the fuel supply assembly housing is disposed adjacent to the at least on fuel injector assembly.

* * * * *